United States Patent [19]

Brown

[11] 4,302,158

[45] Nov. 24, 1981

[54] AUTOMATIC PUMP FOR DEEP WELLS

[76] Inventor: Kenard D. Brown, 3451 Terrace Knoll Ct., Reno, Nev. 89512

[21] Appl. No.: 951,785

[22] Filed: Oct. 16, 1978

Related U.S. Application Data

[63] Continuation-in-part of Ser. No. 651,512, Jan. 22, 1976, Pat. No. 4,120,612.

[51] Int. Cl.[3] ..... F04B 49/04; F04B 21/00

[52] U.S. Cl. ..... 417/20; 417/559

[58] Field of Search ..... 417/20, 392, 390, 559

[56] References Cited

U.S. PATENT DOCUMENTS

| | | | |
|---|---|---|---|
| 1,831,411 | 11/1931 | Dietz | 417/551 |
| 3,027,849 | 4/1962 | Zillman et al. | 417/390 |
| 3,046,904 | 7/1962 | Crow | 417/559 |
| 3,050,006 | 8/1962 | Wolf | 417/390 |
| 3,091,181 | 5/1963 | Wolf | 417/390 |
| 3,225,697 | 12/1965 | Brown | 417/20 |

*Primary Examiner*—William L. Freeh

*Attorney, Agent, or Firm*—Wm. Griffith Edwards

[57] ABSTRACT

An automatic pump for deep wells comprises a long stroke reciprocating pump having its piston normally in its bottom position and an automatic control dependent upon the collection of a predetermined amount of liquid in the pump cylinder above the piston for actuating the piston to pump the liquid into a production line. The automatic control includes an electric motor driven hydraulic pump and a reservoir of hydraulic fluid which is actuated upon filling of the reciprocating pump chamber to supply hydraulic fluid to a closed chamber below the piston and force the piston upwardly to discharge liquid from the pump cylinder. Gas collected in the top of the pump cylinder results in low starting current and a saving of energy. The hydraulic pump is reversed automatically upon completion of the pumping stroke of the piston.

10 Claims, 12 Drawing Figures

AUTOMATIC PUMP FOR DEEP WELLS

This application is a continuation-in-part of my copending application Ser. No. 651,512 filed Jan. 22, 1976, now U.S. Pat. No. 4,120,612 issued Oct. 17, 1978.

This invention relates to an improved down hole pump for oil wells and the like and particularly to a deep well pump for oil field use which is automatic in operation and pumps at a rate determined by the rate of flow of the liquid of the well in which it is installed.

The present invention is an improvement on the invention of my U.S. Pat. No. 3,225,697 issued Dec. 28, 1965.

The deep well pump disclosed in my above patent has provided a system whereby liquids are pumped from the well only after a predetermined volume of liquid has entered the pump cylinder from the formation in which the well is located. Thus power is used only when the predetermined volume of liquid has been accumulated; this represents a substantial saving of energy over that expended for continuous low volume production pump operation. It is an object of my present invention to provide an improved deep well pump of the type which operates only in response to a predetermined accumulation of liquid.

It is another object of my invention to provide a deep well pump of the automatic type including an improved arrangement for reducing the cost of the equipment and the energy expended thereby.

It is another object of my invention to provide an automatic deep well pump which is actuated in response to the accumulation of a predetermined amount of liquid in the pump cylinder and including an improved operating mechanism for the pump.

It is another object of my invention to provide an automatic deep well pump including an improved arrangement utilizing an electric motor in the pump assembly for actuating the pump.

Briefly, in carrying out the objects of my invention in one embodiment thereof, I provide a long stroke reciprocating pump and a hydraulic reservoir and a driving assembly including a hydraulic pump and an electric motor for driving the hydraulic pump; the hydraulic pump delivers fluid from the reservoir which is mounted in the assembly above the long stroke pump. The fluid is delivered to a closed chamber below the piston of the reciprocating pump; when energized, the electric motor drives the hydraulic pump to deliver hydraulic fluid to the closed chamber and drives the piston upwardly thereby delivering the liquid from the cylinder to a production line. Check valves at the discharge end of the pump cylinder prevent reverse flow of the liquid. The upward movement of the reciprocating piston is limited by a switch which reverses the hydraulic pump at a predetermined point, thus reversing the piston and returning the hydraulic fluid to the reservoir. The upper portion of the reservoir may contain a quantity of nitrogen or other neutral gas, which provides a surge chamber action, the return of the fluid compressing the gas to the extent necessary.

The features of novelty which characterize this invention are pointed out with particularity in the claims annexed to and forming a part of this Specification. The invention itself, however, both as to its construction and manner of use, together with further objects and advantages thereof, will best be understood upon reference to the following description taken in connection with the accompanying drawings in which:

The deep well pump of this invention is constructed so that it may be made with a long stroke, for example, fifty feet or more, and so that the pump is actuated only when the pump cylinder has been filled with liquid to a predetermined level; thus the pump is actuated to deliver liquid in accordance with the rate of the supply of the liquid and in units of volume each equal to the cylinder capacity.

Figure 1:
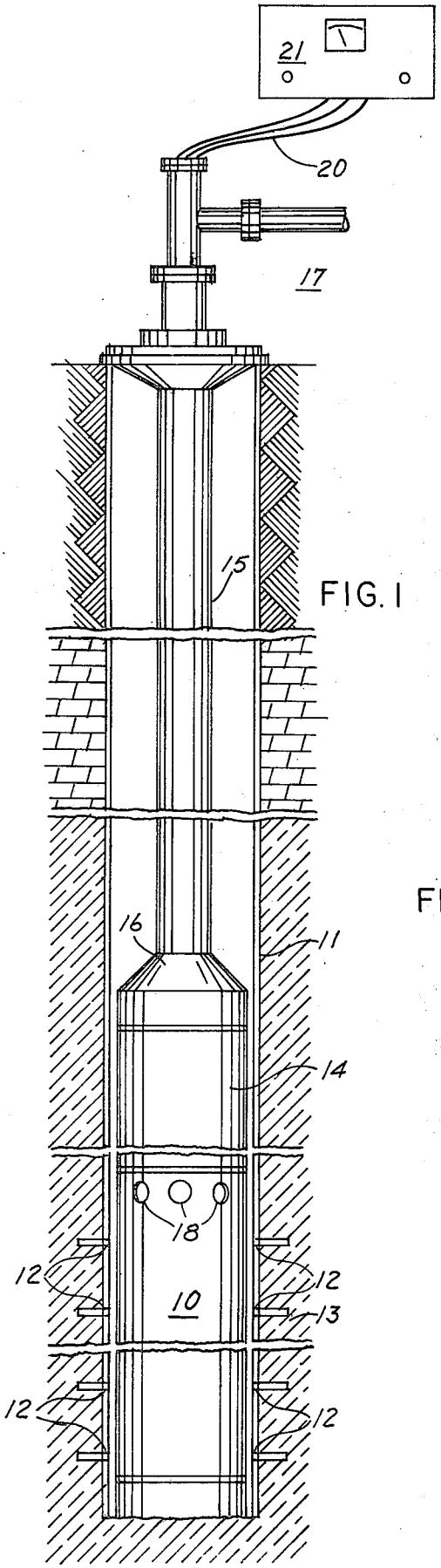
FIG. 1 is a diagrammatic sectional elevation view of a cased well in a reservoir formation having installed therein a deep well pump embodying the invention.

Referring now to the drawings, FIG. 1 illustrates a pump assembly 10 which is positioned within a well casing 11.

The casing is perforated to provide a multiplicity of inlet openings 12 adjacent a producing formation 13; the shot holes extend from the openings 12 into the formation for delivering formation fluids to the interior of the casing. The pump assembly includes a cylindrical housing 14 which is rigidly secured to and supported from a production tubing 15 by a reducing fitting 16. The tubing is suspended from a well head assembly 17. Fluids from the formation enter the casing and, on reaching a plurality of openings 18 in the housing 14, enter the housing where the liquid is accumulated and then pumped to the surface.

Power for driving the pump in the assembly is supplied through three-phase alternating current lines 20 from a conventional power source through a control unit 21. In this embodiment, the lines 20 pass through the production tubing to the pump assembly.

Both the pump assembly 10 and the tubing 15 have been shown with breaks, since both the assembly and the tubing are of much greater length than can be illustrated in proportion in the drawing.

Figure 2:
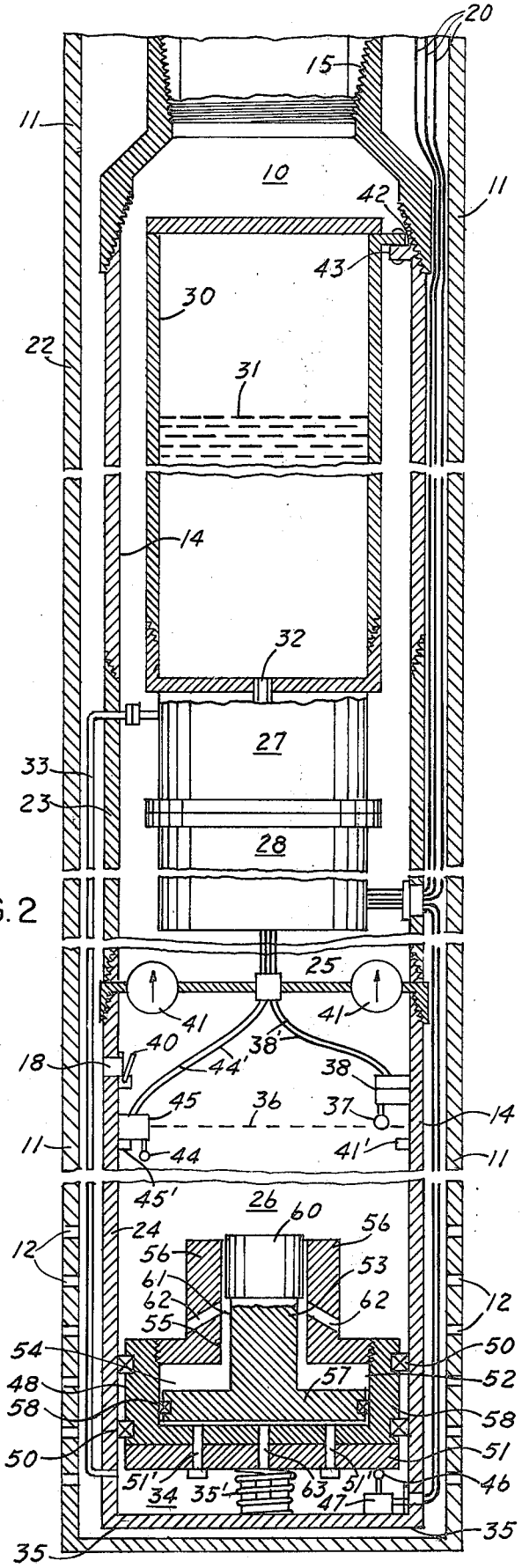
FIG. 2 is an enlarged somewhat diagrammatic sectional elevation view of the pump of FIG. 1.

In FIG. 2, the power lines 20 have been illustrated as lying outside the production tubing and pump assembly housing and pass into the housing through suitable insulating seals. The lines 20 preferably are tied to the production tubing.

The internal arrangement of the pump assembly is shown in FIG. 2; the housing 14 is cylindrical and has been illustrated as comprising upper, middle and lower sections 22, 23 and 24, respectively, which are threaded together by tapered threads in accordance with well known practice. The middle and lower sections are connected by a plate fitting 25 which constitutes a partition between these sections and divides the housing 14 into an upper chamber and a lower chamber. The lower chamber, which is entirely within the section 24, is the cylinder of the deep well pump, and a free piston assembly 26 is installed for reciprocation in the cylinder 24; this assembly being biased by gravity to its lowermost position in the housing. The upper chamber, which is defined by the two sections 22 and 23 has therein a hydraulic pump 27, an electric drive motor 28 therefor, and reservoir or tank 30, which is filled with hydraulic fluid either completely or to a level such as indicated at 31. The reservoir above the liquid may be filled with a neutral gas such a nitrogen. The pump 27 is connected to receive liquid from the tank 30 through an inlet 32 and to deliver liquid through a supply line 33 to an expansible chamber 34 below the piston assembly 26, the bottom of the housing 14 being closed by an end plate 35. In its lowermost position, the pump assembly 26 rests on a spring seat 35, which determines the minimum volume of the expansible chamber 34.

During the operation of the pump assembly, as liquid flows through the openings 18 into the chamber above the piston assembly, it fills the chamber until it reaches a level indicated by a dotted line at 36 which is below the level of the openings 18. Gas also may enter the chamber and accumulates above the liquid. When the liquid reaches the level 36, a float 37 rises and actuates a switch 38, which is connected by leads 38' to the pump motor control and when actuated operates to start the motor 28 and drive the hydraulic pump 27. The motor has been illustrated with a break because the motor is of the deep well type and may be very long as compared with its diameter. The operation of the hydraulic pump produces a flow of high pressure liquid into the chamber 34 and the piston assembly is driven upwardly increasing the pressure in the pump cylinder, actuating check valves 40 to close the openings 18, and delivering fluids through check valves 41 in the partition 25, the fluids being delivered to the production tubing 15. The hydraulic pump and reservoir assembly is suspended within the housing 14 on a plurality of lugs or hangers, one of which is shown at 42 as bolted to an upwardly extending lug 43 at the top end of the section 22. The fluids flow freely upwardly through spaces between the hangers and lugs.

The gas which enters the pump cylinder collects in the upper end of the cylinder above the level of the liquid therein. When the electric motor is started by operation of the float switch 38 it moves the piston 26 against the weight of the accumulated liquid, the gas acts as a cushion and is easily compressed. Thus the starting load on the motor is low and the starting current which it draws is correspondingly low and the motor comes up to speed against a greatly reduced load before it is required to force the piston upwardly against the head of the oil in the production tubing. Thus the gas volume at the top of the pump cylinder serves to decrease the starting load on the motor which increases the life of the motor as well as reducing the power consumed on each operation thereof.

When the piston assembly reaches its top position, it engages an operating element 44 of a limit switch 45; the switch is connected by leads 45' to the pump control and the operation of the switch effects control of the hydraulic pump to reverse the flow of hydraulic fluid. The hydraulic fluid is thus withdrawn from the expansible chamber below the piston assembly 26 and returned to the reservoir 30. This reversal of flow may be accomplished by selecting a reversible pump which is reversed by reversing the electric motor or by providing reversing connections in the hydraulic circuit at the pump, either type of reversal being effected by operation of the limit switch 45. In another method of reversing the hydraulic fluid flow, the piston will strike a rigid stop 45' which may be an annular ring rigidly mounted on the inside wall of the section 24. This stopping of the piston will produce an abrupt rise in the pressure of the hydraulic liquid below the piston, and in the hydraulic pump which will actuate the high pressure control of the hydraulic pump 27 to relieve the excess pressure.

Upon reversal of the flow of hydraulic fluid, the piston assembly 26 returns toward its bottom position by gravity assisted by the removal of hydraulic liquid from below the piston assisted by the low pressure in the reservoir 30, and upon engaging the actuator 46 of a switch 47 stops the motor 28 until another full load of liquid accumulates in the pump chamber.

As shown in FIG. 2, the piston assembly 26 comprises a main piston 48 mounted for sliding movement in the cylinder 24. Leakage between the top and bottom sides of the piston 48 is prevented by suitable annular gaskets or rings 50 mounted in annular grooves about the piston. The piston assembly may be weighted by adding a plate or disc, as illustrated at 51 to facilitate its return to its lowermost position. The disc is illustrated as secured to the piston by bolts 51'.

During the operation of the pump assembly, the fluids entering the pump chamber through the openings 18 may carry some sand or other sediment into the chamber and this foreign matter will tend to settle in the bottom of the chamber on top of the piston assembly 26. In order to minimize the collection of sediment in the pump chamber, a device for agitating the sediment and creating turbulence is provided. For this purpose, the pump assembly 26 is constructed by forming the main piston as an upwardly opening cup thereby providing an internal cylindrical chamber 52 in which a piston 53 is slidably mounted. The chamber 52 includes a large diameter portion 54 and a reduced diameter portion 55; these cylinder portions are formed by a flanged cylindrical member 46 threaded in the larger diameter portion of the main piston. The piston 53 includes a portion 57 fitting the cup 54 and provided with sealing rings 58 to prevent leakage, and a reduced portion 60 extending upwardly through the reduced diameter portion 55 of the chamber 52. The upper portion 60 of the piston 53 acts as a guide and a reduced portion 61 provides communication between the larger diameter chamber or cup 54 and a plurality of downwardly inclined discharge passages 62.

When the operation of the hydraulic pump starts, high pressure liquid is admitted to the chamber 34 and immediately is applied to the lower side of the piston 57 through a port 63, which passes through the weighting disc 51 and the bottom of the main piston 48. This first application of the high pressure liquid forces the piston 53 suddenly upwardly and discharges liquid through the ports 62; the resulting downwardly directed jets of liquid create turbulence and agitate sediment lying on the top of the main piston and facilitate the discharge of the sediment with the liquid forced through the check valves 41, thereby preventing excessive accumulation of sediment and the trapping of sediment in the pump.

Figure 3:
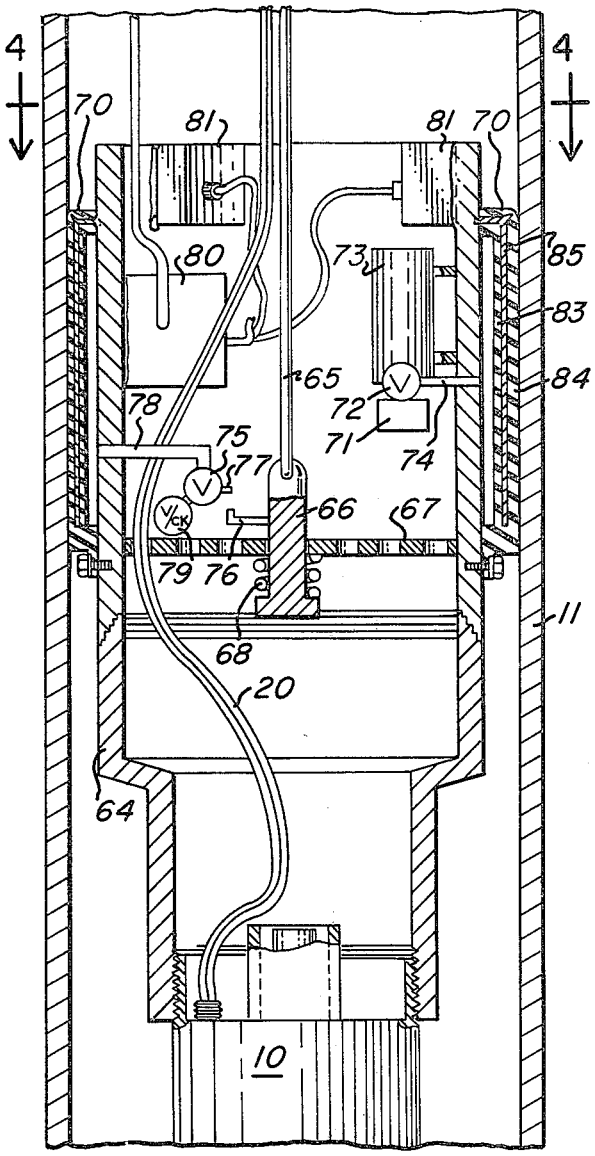
FIG. 3 is an enlarged sectional elevational view illustrating diagrammatically a modified arrangement of the installing device for the pump.

In the modification illustrated in FIG. 3 an arrangement is provided whereby the entire pump assembly may be installed in a well casing on a wire line. As shown in this figure, a pump assembly embodying the invention and indicated at 10 is threaded to a cylindrical base member 64 and is suspended therefrom and lowered through the casing into a well on a wire line 65. The wire line is secured to a spring-biased plunger 66 which is slidably mounted at the center of a perforated wall or partition 67 or is otherwise secured to the inner wall of the base 64. A biasing spring 68 urges the plunger 66 downwardly and is compressed by the weight of the pump assembly when the wire line is lifted and under tension. The electric supply cable 20, which may be tied to the wire line, passes through one of the perforations in the plate 67 and hence enters the pump assembly 10.

An expansible packer 70 is mounted about the cylindrical base 64 and is arranged to be inflated when the pump assembly is in position in the well casing. The inflation of the packer is controlled by a timer 71, which is set to activate a valve 72 at a predetermined time after the pump has reached the desired position in the well. The activation of the valve 72 releases gas under pressure from a tank 73, the pressurized gas flowing through a pipe 74 to the inside of the packer. In FIG. 3, the plunger 66 has been illustrated in its position when the tension on the line 65 has been relieved. In this position the spring holds the plunger down and a valve 75 is in its normally closed position. The discharge of pressurized gas into the packing expands the packing against the casing and maintains the base 64 in position so that operation of the pump assembly 10 may produce a pressure differential between the casing below the packer and the casing above. The liquid may thus be pumped upwardly through the casing above the packer and the produced oil thus be delivered to the surface.

When it is desired to withdraw the pump assembly from the casing, the wire line 65 is tensioned, this compresses the spring 68 and moves an arm 76 upwardly into engagement with an actuating arm 77 of the valve 75. The pressure of the arm 76 against the arm 77 opens the valve 75 and releases the pressure from the packer, the gas flowing through a pipe 78, the valve 75 and a check valve 79. If the packer has not become bonded to the casing due to pressure and high temperatures, the pump assembly can be withdrawn easily from the casing. However, in the event of bonding of the packer to the casing, it may be difficult to withdraw the pump assembly on the wire line and in order to avoid undue stresses, it is desirable to provide an arrangement for effectively releasing the packing from the casing. For purposes of effective release, an arrangement has been provided which utilizes ultrasonic energy to vibrate the packer adjacent the casing. Vibrations at ultrasonic frequencies can break down the bond between the packer and the casing and when pressure is applied to raise the pump assembly on the wire line, the bond may be broken or weakened by the vibration and the packing released under the line tension.

Figure 4:
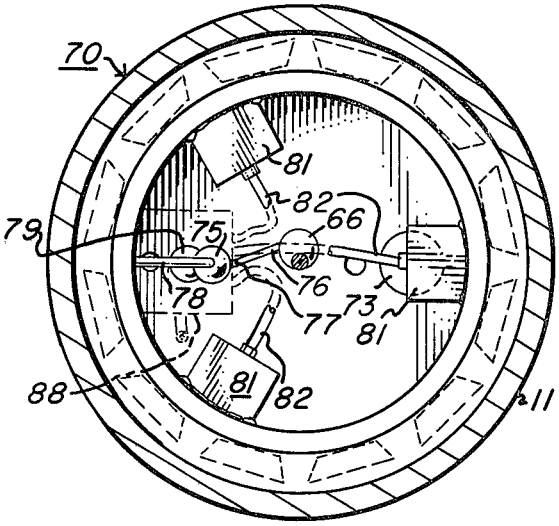
FIG. 4 is a sectional view taken along the line 4—4 of FIG. 3.
Figure 5:
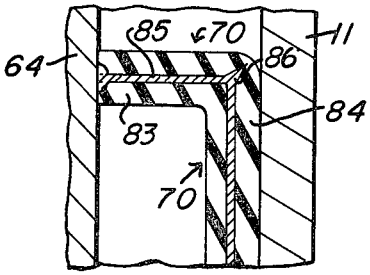
FIG. 5 is an enlarged sectional view of a detail of the structure shown in FIG. 3.

The arrangement for applying ultrasonic energy to the packer as illustrated in FIGS. 3, 4 and 5 includes an ultrasonic frequency generator 80 having a supply lead 80' from the control at the surface; the generator is mounted within the base 64 and connected to apply ultrasonic wave energy to three electromechanical transducers 81 through leads 82. When the transducers 81 are energized they vibrate at ultrasonic frequency and the vibrations are transmitted directly to the base 64 against which the transducers are securely held.

In order to transmit the ultrasonic frequency vibrations to the material of the packer, the packer is constructed of inner and outer layers of material 83 and 84 and a plurality of flexible steel blades 85 are bonded to the material between the layers 83 and 84 and the steel blades are secured rigidly to the base 64 at the level of the transducers 81. The lower ends of the flexible members 85 terminate within the flexible material of the packing, the lower end of the packing being securely bonded to the base 64. The upper ends are also bonded to the base and a space between the base 64 and the packing is provided to receive and hold the pressurized gas. When the base 64 is vibrated by the transducers 81, the vibrations are transmitted directly into the steel members and hence into the material of the packing. The vibrations tend to break the bond between the packing and the casing and under the tension transmitted from the wire line 65, the vibrations facilitate the release of the packing from the casing so that the pump assembly may be withdrawn.

Under severe bonding conditions, it may be desirable to break the packer and for this purpose spurs or blades 86 are secure to the flexible steel members 85 adjacent the turn or corner of the packing at the top. The vibration of these blades when the packer is under tension serves to break the packer material and weaken it and thereby facilitate the removal of the packer from the casing wall. When the base 64 is raised on the wire line, the pressure on the packer will also tend to peel the packer away at its lower side adjacent the casing. Furthermore the steel members 85 may be drawn up and away from the outer layer 84 of the packing material which will then be left at least in part bonded to the casing. Such remaining parts of the packer may easily be removed by suitable casing scrapers available for such purposes.

Figure 6:
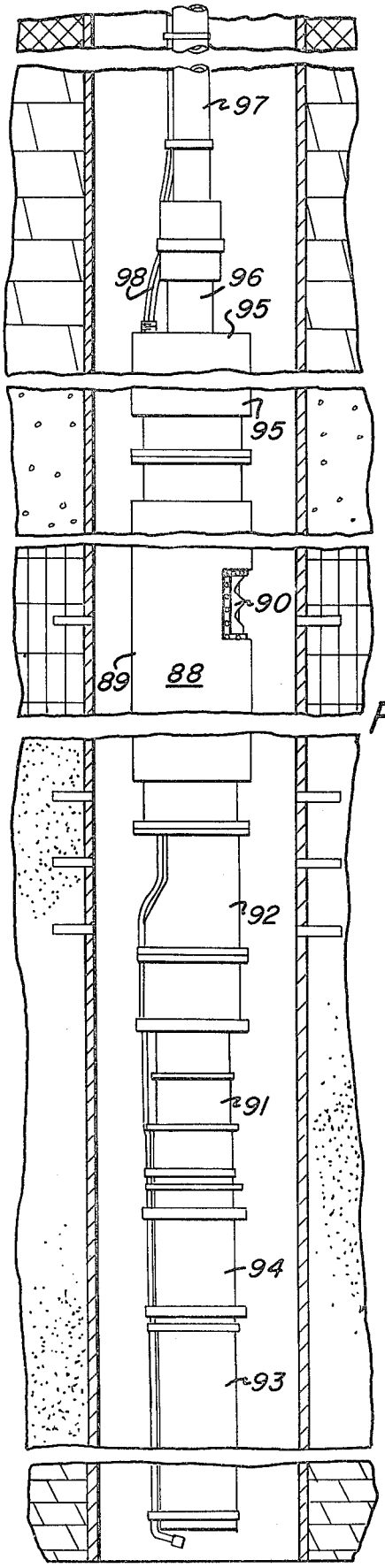
FIG. 6 is an elevation view of a cased well similar to FIG. 1 illustrating a further embodiment of the invention.

The embodiment of the invention illustrated in FIG. 6 includes improved and more efficient arrangements of the components of the deep well assembly. As shown in FIG. 6, the pump assembly indicated generally at 88 is a sectional view through a cased well and showing the pump assembly as a side-elevation view. The assembly may be of substantial length, for example, it may be 50 feet or more in length and for this reason five breaks have been shown through various parts of the assembly. The reservoir fluid pump section is indicated at 89 and includes the reservoir fluid valved inlet assembly 90. The pump includes a piston actuated by hydraulic fluids supplied from a hydraulic pump 91, the housing of which is coupled to the housing of the pump by coupling member 92. The pump 91 is driven by an electric motor 93, motor housing and pump 91 being coupled through a connection 94. Fluid delivered by the pump 89 passes upwardly through the assembly into a heat exchanger 95 wherein the produced reservoir fluid and the hydraulic fluid in the reservoir of the pump assembly are brought into heat exchange relationship and the hydraulic fluid is cooled. Reservoir fluid flows out of the heat exchanger 95 upwardly through an outlet 96 into the production tubing indicated at 97. Electrical power and control wires 98 extend upwardly from the pump assembly 88 on the production tubing 97 and reach the well head indicated in FIG. 7 where the well casing, indicated at 99, is closed by a plate 100 through which the production tubing 97 extends and delivers the reservoir fluid to a distribution line 101 through a T-connection 102. The electrical power and control unit is indicated at 103 and is connected to the pump assembly through the lines 98.

Figure 7:
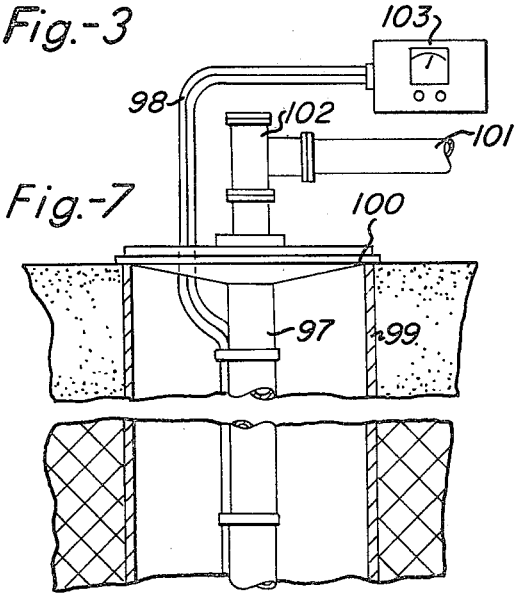
FIG. 7 is a sectional view of the well head mounting of the pump of FIG. 6.

FIG. 7 which is an enlarged sectional view through the pump assembly 88 shows the details of the construction of the assembly.

Figure 8:
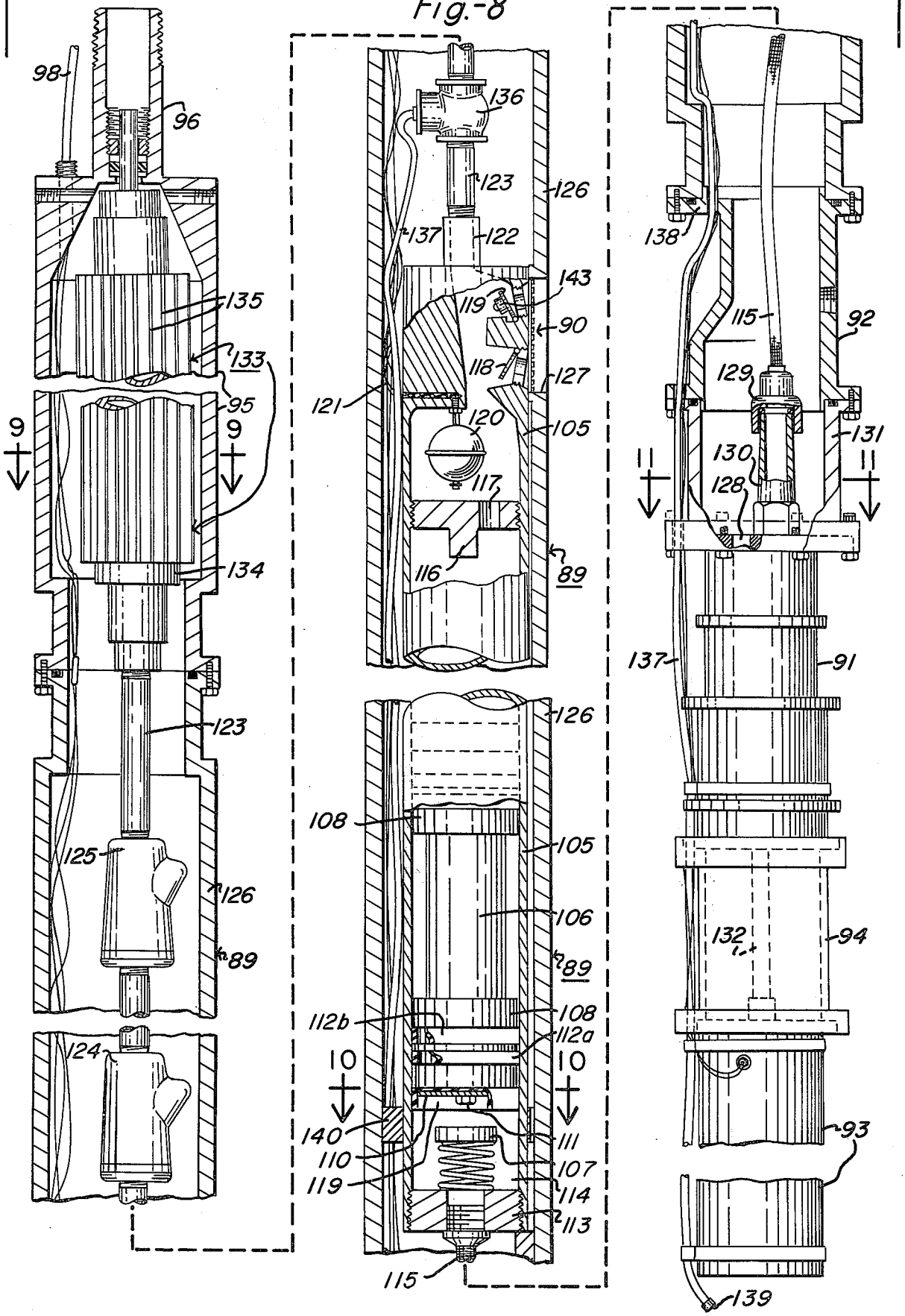
FIG. 8 is an enlarged view, partly in section, of the pump of FIG. 6.

As shown in FIG. 8, the reservoir fluid pump 89 comprises a pump cylinder 105 and a piston 106 which is free for reciprocating movement in the cylinder. The piston has been shown in a position just above the spring pressed bottom rest indicated at 107. The piston comprises a main body of reduced diameter and heads 108 which carry the sealing rings and end cups. The body is hollow and is filled with lead to weight the piston sufficiently to overcome the head of the hydraulic liquid in the reservoir and to assure return of the piston to its bottom position. The bottom end cup as indicated at 109 is secured to the bottom of the piston by a disc or plate 110 clamped to the piston by a bolt 111. In addition the head 108 is provided with two grooves, one carrying a sealing ring 112*a* and the other carrying an alignment ring 112*b*, the rings are shown partly broken away to indicate more clearly their construction. The lower end of the cylinder 105 is closed by a block 113 which carries the spring stop 111 and is provided with a central opening through which hydraulic fluid passes to and from an expansible chamber 114 below the piston, fluid entering and leaving the chamber through a pressure resistance tubing 115. The piston stop 116 is threaded into the upper end of the cylinder 105 and is provided with one or more passages 117 for the passage of liquid. Reservoir fluid is admitted to the cylinder 105 through the check valve assembly 90 which comprises a lower flapper valve 118 and an upper flapper valve 119. The lower valve 118 is intended primarily for the admission of liquid and the upper valve 119 affords the outward passage of gas when the cylinder is being filled with liquid. During the operation of the system, when liquid flows into the cylinder 105, it fills the cylinder and when it reaches a sufficient level raises a float 120. The float 120 includes a magnet and when the float rises, the magnet passes adjacent a reed switch which is closed thereby and closes a circuit to energize the motor 93 to operate the pump 91 and drive the piston 106 upwardly to discharge the collected reservoir fluid from the cylinder 105 through an outlet 122 and a discharge pipe 123. When the piston 108 strikes the stop 116 it produces a surge in the current of the motor 93 and the control 103 operates to stop the motor and allow the piston to return to its bottom position against the spring stop 111. The ball check valves 124 and 125 are provided in the line 123 to prevent the return of fluid to the cylinder 105. The two check valves are provided in series so that should either of them become inoperative the other will be effective to stop the return flow.

Figure 9:
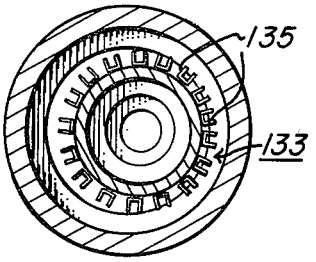
FIG. 9 is a sectional view taken along the line 9—9 of FIG. 8.

The cylinder 105 and associated parts of the pumping assembly are mounted within a cylindrical housing 126 having an internal diameter greater than the diameter of the cylinder 105. A window 127 is provided in the wall of the housing 126 opposite the check valve assembly 90 and the check valve assembly is sealed in position adjacent the window, the seal preventing leakage into or out of the space between the cylinder 105 and the housing 126. The space between the pump assembly and the housing 126 and all of the space within the housing between the pump 91 and the top of the housing constitutes the reservoir for the hydraulic fluid. The pump 91 is provided with an inlet 128, communication with the hydraulic fluid reservoir and a friction connection or stabbing joint 129 for connecting the output nipple 130 of the pump with the supply line 115 to the chamber 114. A coupling cylinder 131 flanged at both ends is arranged to engage corresponding flanges on the pump 91 and flange coupling members or sleeves are employed for facilitating the assembly and disassembly of the pump assembly. The flanged coupling or spool 94 is provided to connect the motor housing and the housing of the pump 91, the motor shaft passing through the spool 94 as indicated by the dotted lines 130–132. Within the upper end of the housing there is provided a heat exchanger 133 comprising a cylinder 134 having a multiplicity of fins 135 extending axially of the cylinder and comprising a multiplicity of channel members as indicated in FIG. 9. A break has been indicated in the heat exchanger and adjacent parts of the assembly since the length of the heat exchanger may be of the order of 25 to 30 feet. The heat exchanger operates to exchange heat between the reservoir fluid pumped upwardly through the pump assembly and the hydraulic fluid surrounding the assembly within the housing 89.

Figure 10:
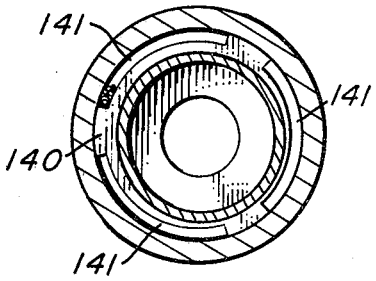
FIG. 10 is a sectional view taken along the line 10—10 of FIG. 8.
Figure 11:
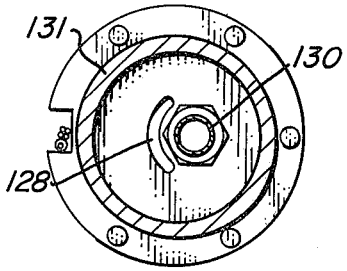
FIG. 11 is a sectional view taken along the line 11—11 of FIG. 8.
Figure 12:
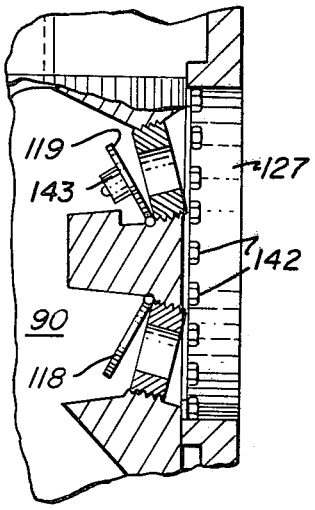
FIG. 12 is an enlarged sectional view of the inlet valve assembly shown in FIG. 8.

During its operation the motor 93 generates substantial heat and in order to prevent excessive heating a portion of the reservoir fluid discharged through the line 123 is bypassed through a T-connection 136 and delivered through a tubing 137 downwardly through the casing and to the exterior of the casing at a flange 138 in the coupling or spool 92. The tubing 137 then continues downwardly and is secured to the outside of the pump assembly and finally terminates in an outlet 139 below the motor 93. The liquid thus discharged below the motor produces a circulation of fluid about the motor and the fluid circulating about the motor removes heat from the motor. Furthermore, the turbulence produced by the circulation of fluid minimizes the collection and accumulation of debris or trash on the motor housing. As shown in the section FIG. 10, a spacer 140 is provided about the lower end of the cylinder 105 to position the cylinder in the desired position with respect to the housing 89. The spacer 140 is provided with slots 141 to afford the passage of the hydraulic fluid in the reservoir about the pump assembly. FIG. 11 shows the section adjacent the top of the pump 91 and shows the position of the inlet 128 and outlet 130 of the pump.

The flow of reservoir fluid into the cylindrical casing 15 above the piston 106 is controlled by the operation of the flapper valve assembly 90, this assembly being secured in position within the window 127 by a multiplicity of bolts 142. These valves are arranged to snap shut instantly on a change in pressure and to seal effectively over long periods of time. The upper valve 119 is provided primarily to afford the discharge of gas from the cylinder 105 when it is being filled with liquid flowing in through the valve 118. The valve 119 may be provided with a float 143 which assures closing of the valve unit when the liquid reaches the level of the valve 119. Both the valves 118 and 119 close to prevent discharge of fluids when the piston moves upwardly.

The operation of the pump assembly as disclosed in FIG. 8 is under control of the float 120 and the stop 116 for initiating the forward and return strokes, respectively, of the piston 106. The pump assembly will operate effectively over long periods of time, the motor being energized only when a predetermined amount of liquid has accumulated in the pump cylinder so that the pump is effective for operation in wells with minimum use of power and with minimum need for inspection or servicing. The unloading of the motor 93 for starting is effected in the same manner as the unloading of the motor 28 of the embodiment of FIGS. 1 and 2. Furthermore, the assembly provides a minimum of visible equipment at the surface and minimum interference with the environment.

During tests of a sample pump embodying the invention, it has been found that the pump assembly works effectively for use in a well which maintains a level of reservoir fluid above the inlet valves. In this case, the pump operates continuously, the pumping cylinder filling immediately after each operation of the pump so that continuous operation is effected. On each operating cycle of the pump motor unloaded starting occurs, there being sufficient gas containing open volume at the top of the pump cylinder to effect unloading of the pump as described hereinbefore. Gas is normally present in the reservoir fluid and is liberated upon any lowering of the pressure on the fluid.

While the invention has been described in connection with specific embodiments thereof, various modifications and other arrangements will occur to those skilled in the art. Therefore, it is not desired that this invention be limited to the specific constructions illustrated and described and it is intended by the appended claims to cover all modifications which fall within the spirit and scope of the invention.

I claim:

1. A deep well pump assembly including an upwardly extending cylinder having a free piston therein and an outlet conduit for the discharge of fluid therefrom, means for admitting reservoir liquid from a well to said cylinder above said piston, a hydraulic fluid supply and means including a motor driven hydraulic pump within said assembly having an inlet and an outlet and connected for forcing hydraulic fluid from said supply to said cylinder below said piston to drive the piston upwardly and discharge reservoir liquid from said cylinder through said conduit, a check valve for preventing the return of discharged liquid to said cylinder, control means dependent upon the accumulation of a predetermined quantity of liquid in said cylinder for initiating operation of said hydraulic pump to effect the forward stroke of said piston, said piston returning to its initial position upon completion of its forward stroke, and repeating said forward stroke upon each accumulation of said predetermined quantity of liquid;

a cylindrical housing having an internal diameter greater than the diameter of said cylinder and enclosing said cylinder while leaving substantial space between said housing and said cylinder about the fluid connection to said cylinder and about at least a portion of said cylinder, said motor and hydraulic pump being connected in driving relationship and including casings forming a unit of elongated generally cylindrical configuration, said hydraulic pump constituting a bottom closure for said housing, said space about said cylinder and the connections thereto constituting a reservoir for hydraulic fluid and said pump inlet being in open communication with said space, and said reservoir fluid admitting means including an opening in said housing and a check valve mounted in said cylinder adjacent said opening and means for sealing said cylinder and said housing about said opening for preventing leakage of hydraulic fluid from said reservoir.

2. A deep well pump assembly including an upwardly extending cylinder having therein a free reciprocatable piston and arranged to receive reservoir liquid from a well and having a discharge conduit for delivering liquid to the surface, means including an electric motor within said assembly for actuating the piston dependent upon the accumulation of a predetermined quantity of reservoir liquid in the cylinder above the piston, means including a hydraulic pump connected to be driven by said motor and having an outlet to deliver liquid to said cylinder below said piston for driving said piston upwardly in said cylinder to discharge fluid from said cylinder, an elongated cylindrical housing completely surrounding said cylinder and sealed by said pump at its bottom end and sealed about said discharge conduit at its upper end and constituting a reservoir for hydraulic fluid extending substantially about the entire cylinder, said pump having its inlet in open communication with said reservoir at the bottom thereof, and wherein said arrangement for receiving reservoir liquid includes an opening in the wall of said cylinder and a check valve mounted therein and an adjacent opening in the wall of said housing and means for sealing said cylinder and said housing together about said openings for preventing discharge of hydraulic fluid from said reservoir.

3. The invention of claim 2 including a heat exchanger of extended length between the liquid in said discharge conduit and the fluid in said reservoir for cooling the hydraulic fluid in said reservoir.

4. The invention of claim 2 wherein said piston is hollow and at least partially filled with lead to provide weight sufficient to overcome the weight of the maximum amount of fluid in said reservoir whereby said piston will return by gravity to its bottom position.

5. The invention of claim 2 including means for bypassing a portion of the fluid from said pump discharge conduit and releasing it adjacent the bottom wall of the housing of said motor whereby circulation of fluid about said motor is induced for effecting cooling of the motor.

6. The invention of claim 2 including a second check valve above said first mentioned check valve for affording a discharge of gaseous fluid from said cylinder during filling of said cylinder with liquid, both said valves closing during upward movement of said piston.

7. The invention of claim 6 wherein said second mentioned check valve is biased by gravity toward its open position, and including a float on said second valve for facilitating the closing of said second valve when liquid rises to its level.

8. A deep well pump assembly comprising: a closed chamber having an inlet near to and spaced from the upper end thereof, said chamber having an outlet for discharging fluid from said upper end into the production tubing of the well, means in said assembly including a piston in said chamber and an electric motor for driving said piston to move liquid upwardly in said chamber and for discharging the liquid through said outlet, check valves for said inlet and outlet, said inlet being located a substantial distance below said outlet whereby a substantial volume of said chamber at the upper end thereof is adapted for accumulating gas, means dependent upon the accumulation of liquid to a predetermined level in said chamber for starting said electric motor, said driving means being effective upon starting of said motor to raise said piston and lift the liquid in said chamber and compress the gas in the upper end thereof until said outlet valve is opened and the gas and liquid is driven upwardly into the production tubing against the pressure head of the liquid in the tubing, the starting load on said motor being essentially only the weight of the liquid in said chamber whereby the motor is effectively unloaded during starting and comes up to speed against a low load, and means dependent upon the discharge of substantially the full load of accumulated liquid from said chamber for restoring said driving means to its initial position, said assembly further including two inlet check valves, one above the other, the lower one of said valves affording the flow of liquid into said chamber and the upper one of said inlet valves remaining open during the admission of fluid to said chamber and allowing gas to leave said chamber when displaced by the liquid therein, both said inlet valves closing to prevent discharge of liquid from said chamber therethrough during the upward movement of liquid over said inlet valves.

9. A deep well pump assembly as set forth in claim 8 wherein said upper inlet valve is biased toward its open position, and a float on said upper valve for facilitating the closing of said upper valve when liquid rises to its level.

10. The invention of claim 9 or claim 7 wherein said valves are flapper valves.

* * * * *